United States Patent [19]

Motosugi et al.

[11] Patent Number: 4,507,670

[45] Date of Patent: Mar. 26, 1985

[54] THERMOSENSITIVE RECORDING MATERIAL

[75] Inventors: Takanori Motosugi; Hisashi Sakai, both of Numazu; Kiyotaka Iiyama, Mishima, all of Japan

[73] Assignee: Ricoh Company, Ltd., Tokyo, Japan

[21] Appl. No.: 573,432

[22] Filed: Jan. 24, 1984

[30] Foreign Application Priority Data

Jan. 25, 1983 [JP] Japan ..... 58-10387

[51] Int. Cl.[3] ..... B41M 5/00

[52] U.S. Cl. ..... 346/208; 346/209; 346/214; 346/217; 346/219; 346/221; 346/225; 346/226

[58] Field of Search ..... 346/208, 209, 214, 216, 346/217, 219, 221, 225, 226

[56] References Cited

U.S. PATENT DOCUMENTS

| | | | |
|---|---|---|---|
| 2,813,042 | 11/1957 | Gordon et al. | 346/225 |
| 3,442,682 | 5/1969 | Fukawa | 346/217 |
| 4,421,344 | 12/1983 | Ikezawa et al. | 428/328 |

*Primary Examiner*—Bruce H. Hess

*Attorney, Agent, or Firm*—Flynn, Thiel, Boutell & Tanis

[57] ABSTRACT

A thermosensitive recording material comprising a support material and a thermosensitive recording layer formed thereon, in which thermosensitive coloring layer, colored images are formed by the reaction between a colorless or light-colored leuco dye of the following formula (I) and a color developer of the following formula (II) which is capable of inducing color formation in the leuco dye upon application of heat thereto,

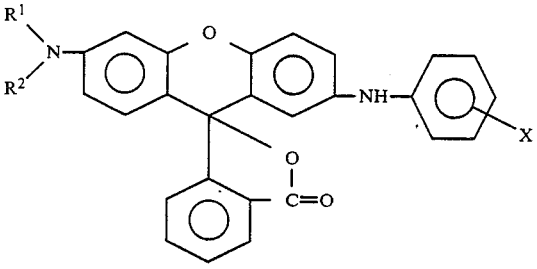

(I)

wherein $R^1$ and $R^2$ each indicate a lower alkyl group, and X indicates halogen,

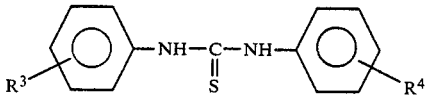

(II)

wherein $R^3$ and $R^4$ each indicate hydrogen, halogen, an alkyl group, an acyl group, a halogenated alkyl group or an unsubstituted or substituted aromatic group.

12 Claims, No Drawings

THERMOSENSITIVE RECORDING MATERIAL

BACKGROUND OF THE INVENTION

The present invention relates to an improved thermosensitive recording material comprising a support material and a thermosensitive coloring layer formed thereon, in which thermosensitive coloring layer, colored images are formed by the reaction between a colorless or light-colored leuco dye and a color-developer which induces color information in the leuco dye when heat is applied thereto. More particularly, it relates to a thermosensitive recording material of the above-mentioned type which is particularly improved with respect to the thermosensitive recording performance, with preservability and stability of the developed images with high resistance to moisture, heat, light, chemicals and oils, and the whiteness of the background.

A conventional thermosensitive recording material comprises a support material, such as paper, synthetic paper or a plastic film, and a thermosensitive coloring layer formed thereon which consists essentially of a composition which is colored upon application of heat thereto. On the thermosensitive recording material, colored images are formed by application of heat by use of a thermal head or a thermal pen, or by application of laser beams thereto. Recording materials of this kind are widely used for making copies from books and documents or as output charts for computers and facsimile apparatus, tickets for use with vending machines, labels and other charts for recording, since in comparison with other recording materials, they have the advantages that complex recording steps, such as development and image fixing, are unnecessary, recorded images can be quickly obtained by a comparatively simple apparatus, no noise is generated during operation, and they are free from a problem of air pollution and cheaper than other recording materials.

A thermosensitive composition for color formation employed in such a thermosensitive recording material is generally composed of a coloring agent and a color developer which is capable of inducing color formation in the coloring agent upon application of the heat thereto.

As the coloring agent, for example, colorless or light-colored leuco dyes having lactone rings, lactam rings or spyropyran rings are employed.

As the color developer, a wide variety of acidic materials such as organic acids and phenolic materials are employed. The recording materials in which such a coloring agent and a color developer are used in combination have the advantages that the color tone of the images is clear, the whiteness of the background is high and the images are excellent in weathering resistance. Therefore they are widely used.

Recently other conventional recording systems are being replaced by thermosensitive recording systems and a demand for thermosensitive systems in increasing. In accordance with this trend, further improvement of the quality of the thermosensitive recording materials for use with the thermosensitive recording systems is desired. In particular, a thermosensitive recording material which is improved on the whitenes of the background and the preservability of the developed images is desired. In order to improve the preservability and stability of the developed image, it is proposed that a mixture of two or more leuco dyes be employed, for instance, in Japanese Laid-Open Patent Application No. 54–109454, and a mixture of an organic acid and a phenolic material be employed as a color developer, for instance, in Japanese Patent Publication No. 51–43386. In the case of these prior art methods, when the preservability and stability of the developed images are improved, the fogging of the background takes place, resulting in that the whiteness of the background is decreased. On the other hand, when the whiteness of developed images is increased by preventing the fogging of the background from taking place, the preservability and stability of the images inevitably decreases.

SUMMARY OF THE INVENTION

It is therefore an object of the present invention to provide a thermosensitive recording material which is particularly improved with respect to the thermosensitive recording performance, the preservability and stability of the developed images and the whiteness of the background.

This object of the present invention can be attained by a thermosensitive recording material comprising a support material and a thermosensitive recording layer formed thereon, in which thermosensitive coloring layer, colored images are formed by the reaction between a colorless or light colored leuco dye of the following formula (I) and a color developer of the following formula (II) which is capable of inducing color formation in the leuco dye upon application of heat thereto, Leuco dye:

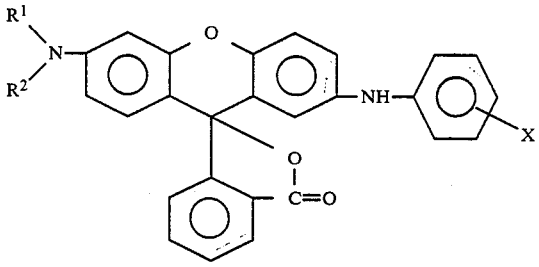

(I)

wherein $R^1$ and $R^2$ each indicate a lower alkyl group, and X indicates halogen. As the lower alkyl group, an alkyl group having 1 to 5 carbon atoms is preferable. As the halogen, chlorine, bromine, iodine and fluorine are all suitable for the substituent in the formula of the above leuco dye.

Color developer:

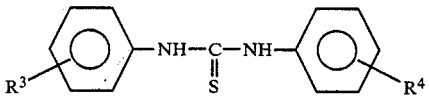

(II)

wherein $R^3$ and $R^4$ each indicate hydrogen, halogen, an alkyl group, an acyl group, a halogenated alkyl group or an unsubstituted or substituted aromatic group. In the above formula, as the alkyl group, a lower group group and a higher alkyl group are both suitable. As the acyl group and the halogenated alkyl group are both derived from the above mentioned alkyl group. As the aromatic group, an aryl group such as phenyl, tolyl, naphthyl and phenetyl, and an aralkyl group are suitable. As the substituent of the aromatic group, halogen, an acyl group and a halogenated alkyl group are suitable.

DETAIL DESCRIPTION OF THE PREFERRED EMBODIMENTS

Specific examples of the leuco dye represented by the above described Formula (I) are as follows:
3-diethylamino-7-chloroanilinofluoran,
3-diethylamino-7-m-chloroanilinofluoran,
3-diethylamino-7-p-chloroanilinofluoran,
3-di(n-butyl) amino-7-o-chloroanilinofluoran,
3-di(n-butyl) amino-7-m-chloroanilinofluoran, and
3-di(n-butyl) amino-7-p-chloroanilinofluoran.

Specific examples of the color developer represented by the general formula (II) are as follows:
1,3-di(o-triphloromethylphenyl)thiourea,
1,3-di(m-triphloromethylphenyl)thiourea,
1,3-di(p-triphloromethylphenyl)thiourea,
1,3-di(o-chlorophenyl)thiourea,
1,3-di(m-chlorophenyl)thiourea,
1,3-di(p-chlorophenyl)thiourea,
1,3-di(o-methylphenyl)thiourea,
1,3-di(m-methylphenyl)thiourea,
1,3-di(p-methylphenyl)thiourea,
1,3-di(o-bromophenyl)thiourea,
1,3-di(m-bromophenyl)thiourea,
1,3-di(p-bromophenyl)thiourea,
1,3-di(o-ethylphenyl)thiourea,
1,3-di(m-ethylphenyl)thiourea,
1,3-di(p-ethylphenyl)thiourea,
1,3-di(p-isopropylphenyl)thiourea,
1,3-di(p-isobutylphenyl)thiourea,
1,3-di(p-isoamylphenyl)thiourea,
1,3-di(p-octylphenyl)thiourea,
1,3-di(p-laurylphenyl)thiourea,
1,3-di(p-styarylphenyl)thiourea,
1,3-di(p-methylcarbonylphenyl)thiourea,
1,3-di(p-isopropylcarbonylpuenyl)thiourea,
1,3-di(p-diphenyl)thiourea, and
1,3-diphenylthiourea In the present invention, the color developers represented by the general formula (II) can be used in combination with an inorganic color developer, if necessary, in order to improve the stability of developed images, that is, the resistance of the images to chemicals and oils. As the inorganic color developer, metal salts such as zinc chloride, magnesium chloride and aluminium chloride, and active terra abla, acidic terra abla, bentonite, colloidal silica, aluminium silicate, magnesium silicate and zinc silicate can be used. These inorganic color developers can be used in an amount of 5.0 parts by weight or less, preferably in the range of 0.1 part by weight to 2.0 parts by weight, with respect to 1 part by weight of the color developer of the general formula (II). It is not always necessary that the inorganic color developers be used in the form of the mixture with the color developer of the general formula (II), but they can be contained in the support material of the thermosensitive recording material, in an undercoat layer interposed between the thermosensitive coloring layer and the support material, or in an overcoat layer formed on the thermosensitive coloring layer.

In the present invention, a wide variety of conventional binder agents can be used for binding and supporting the above-mentioned leuco dyes and color developers on the support material. Examples of such binder agents are as follows: polyvinyl alcohol, starch and derivatives thereof, cellulose derivatives such as methoxy cellulose, hydroxyethylcellulose, carboxymethylcellulose, water soluble polymeric materials such as sodium polyacrylate, polyvinyl pyrrolidone, styrene/maleic anhydride copolymer, isobutylene/maleic anhydride copolymer, polyacrylamide and gelatin, and aqueous emulsions of SBR latex, styrene/acrylic acid ester copolymer, vinyl chloride/vinyl acetate copolymer, and polybutyl methacrylate.

Further, in the present invention, conventional auxiliary additives can be used in combination with the above-mentioned leuco dyes and color developers. Examples of such auxiliary additives are calcium carbonate, zinc oxide, silica, barium sulfate, aluminium stearate and urea-formaldehyde resin. These auxiliary additives are used in the form of fine powder and serve to increase the whiteness of the background, pencil writing acceptance and thermal head matching properties of the recording material. Furthermore, in the present invention, a thermo-fusible material with a melting point ranging from about 70° to about 150° C., such as stearamide, dimethyl phthalate and benzoic acid phenyl ester derivatives can also be used for increasing the thermal response of the recording material.

The thermosensitive recording material according to the present invention can be used in various structures including the conventional structures in which the thermal coloring reaction between the leuco dyes and the color developers are employed. For example, the thermosensitive recording material according to the present invention can be formed in a structure in which the leuco dye and the color developer are contained in the same coating layer on a support material. In another example, the thermosensitive coloring layer can be constructed so as to include at least 2 layers, and leuco dye is contained in one layer andd the color developer is contained in the other layer.

The thermosensitive recording material according to the present invention can also be used in the form of an image-transfer type recording material, for instance, consisting of a transfer sheet with an image-transfer layer thereon containing the above-mentioned leuco dye and an image receiving sheet with an image receiving layer thereon containing the above-mentioned color developer.

In the image-transfer type recording material, it is preferable that the leuco dye and the color developer be respectively applied to each support material with a deposition of 0.3 $g/m^2$ to 50 $g/m^2$ when dried, more preferably, with a deposition of about 0.5 $g/m^2$ to about 30 $g/m^2$ when dried.

When the above-mentioned mentioned image-transfer type thermosensitive recording material is prepared, the components necessary for forming an image transfer layer and the components necessary for forming an image receiving layer are separately dispersed together with a solvent such as water in a ball mill or in an attritor as will be described more specifically, whereby an image transfer layer formation liquid and an image receiving layer formation liquid are prepared and are then applied to each support material, for instance, with a deposition of about 0.3 $g/m^2$ to 30 $g/m^2$ when dried, so that the image-transfer type thermosensitive recording material is prepared.

When thermal image transfer is conducted by use of the image-transfer type recording material having an imagewise formed image transfer layer, the image receiving sheet is superimposed on the image transfer layer, and the image transfer sheet and the image receiving sheet are caused to pass, for instance, between a pair of heat application rollers. When the image transfer sheet has no imagewise formed image transfer layer, but it has a solid image transfer layer on the entire surface thereof, the image receiving sheet is closely superimposed on the image transfer layer of the image transfer sheet, and direct thermal printing is conducted by use of a thermal printer from the back side of the image transfer sheet.

Embodiments of a thermosensitive recording material according to the present invention will now be explained in detail by referring to the following examples:

Example 1

Preparation of Liquid A

A mixture of the following components was disperesed in a ball mill for 24 hours, whereby Liquid A was prepared.

| | Parts by Weight |
|---|---|
| 3-di(n-butyl)amino-7-o-chloro-anilinofluoran | 20 |
| 10% aqueous solution of hydroxyethyl-cellulose | 20 |
| Water | 60 |

Preparation of Liquid B

A mixture of the following of the following components was dispersed in a ball mill for 24 hours, whereby Liquid B was prepared.

| | Parts by Weight |
|---|---|
| 1,3-di(p-methylphenyl)thiourea | 20 |
| Calcium carbonate | 20 |
| 10% aqueous solution of hydroxyethyl-cellulose | 20 |
| Water | 40 |

By mixing 10 parts by weight of Liquid A and 40 parts by weight of Liquid B, a thermosensitive coloring layer formation liquid was prepared. This liquid was applied to a sheet of high quality paper with a base weight of 50 g/m$^2$ and was then dried to form a thermosensitive coloring layer thereon with a deposition of 4 g/m$^2$ when dried, whereby a thermosensitive recording material No. 1 according to the present invention was prepared.

The thus prepared thermosensitive recording material No. 1 was subjected to an image formation test for measuring the image density and the background density, a moisture resistance test for inspecting the resistance of the images to moisture, a heat resistance test for inspecting the resistance of the images to heat, and a plasticizer resistance test for inspecting the resistance of the images to a plasticizer.

In the image formation test, images are formed on the recording material No. 1 by use of a commercially available thermal facsimile apparatus (RIFAX-5320 made by Ricoh Co., Ltd.) and the image density of the formed images and the background density were measured by use of a Macbeth densitometer RD 514 equipped with a filter W-106.

In the moisture resistance test, the recording material with the images formed thereon was allowed to stand at 40° C. and 90 RH % for 24 hours and the image density was then measured by use of the Macbeth densitometer.

In heat resistance test, the recording material with recorded images thereon was allowed to stand at 60° C. in a dry state for 24 hours and the background density was then measured by used of the Macbeth densitometer.

In the plasticizer resistance test, a mending tape containing a plasticizer (commercially availiable from 3M Co., Ltd.) was applied to the image area of the recording material and was then allowed to stand at room temperature and room humidity for 24 hours and the fading degree of the image area was visually inspected.

The results of the above tests are shown in Table 1.

EXAMPLE 2

Example 1 was repeated except that the color developing material, 1,3-di(p-methylphenyl)thiourea, in the Liquid B employed in Example 1 was replaced by 1,3-di(m-chlorophenyl)thiourea, whereby a thermosensitive recording material No. 2 according to the present invention was prepared.

The thermosensitive recording material No. 2 was subjected to the same tests as those in Example 1. The results are shown in Table 1.

EXAMPLE 3

Example 1 was repeated except that the color developing material, 1,3-di(p-methylphenyl)thiourea, in the Liquid B employed in Example 1 was replaced by 1,3-di(m-triphloromethylphenyl)thiourea, whereby a thermosensitive recording material No. 3 according to the present invention was prepared.

The thermosensitive recording material No. 3 was subjected to the same tests as those in Example 1. The results are shown in Table 1.

COMPARATIVE EXAMPLE 1

Example 1 was repeated except that the color developing material, 1,3-di(p-methylphenyl)thiourea, in the Liquid B employed in Example 1 was replaced by Bisphenol A, whereby a comparative thermosensitive recording material No. 1 was prepared.

The comparative thermosensitive recording material No. 1 was subjected to the same tests as those in Example 1. The results are shown in Table 1.

TABLE 1

| | Color Developing Material | Image Density | Background Density | Moisture Resistance | Heat Resistance | Plasticizer Resistance |
|---|---|---|---|---|---|---|
| Example 1 | 1,3-di(p-methylphenyl)thiourea | 1.20 | 0.06 | 1.10 | 0.07 | Slightly faded |
| Example 2 | 1,3-di(m-chlorophenyl)thiourea | 1.30 | 0.06 | 1.25 | 0.07 | Slightly faded |
| Example 3 | 1,3-di(m-triphloromethylphenyl)thiourea | 1.25 | 0.06 | 1.20 | 0.07 | Slightly faded |
| Comparative Example 1 | Bisphenol A | 1.20 | 0.08 | 0.90 | 0.15 | Images disappeared |

EXAMPLE 4

A mixture of the following components was dispersed in a ball mill for 24 hours, whereby Liquid C was prepared.

| | Parts by weight |
|---|---|
| Calcium Carbonate | 40 |
| Zinc chloride | 10 |
| Styrene-butadiene latex emulsion (48% solid components) | 10 |
| 10% aqueous solution of hydroxyethylcellulose | 10 |
| Water | 30 |

The thus prepared Liquid C was applied to a sheet of high quality paper with a base weight 50 g/m$^2$ and was then dried to form an undercoat layer thereon with a deposition of 3 g/m$^2$ when dried. After the undercoat layer was formed, the same thermosensitive coloring layer as that in Example 2 was formed on the undercoat layer, whereby a thermosensitive recording material No. 4 according to the present invention was prepared.

EXAMPLE 5

To the thermosensitive coloring layer of the thermosensitive recording material No. 2 which was prepared in Example 2, there was applied the Liquid C prepared in Example 4 with a deposition of 2 g/m$^2$ when dried to form a protective layer on the thermosensitive coloring layer, whereby a thermosensitive recording material No. 5 according to the present invention was prepared.

EXAMPLE 6

Example 2 was repeated except that 10 parts by weight of a 20% aqueous solution of zinc chloride was added to the formulation of the thermosensitive coloring layer formation liquid in Example 2, whereby a thermosensitive recording material No. 6 according to the present invention was prepared.

COMPARATIVE EXAMPLE 2

Comparative Example 1 was repeated except that 10 parts by weight of a 20% aqueous solution of zinc chloride was added to the formulation of the thermosensitive coloring layer formation liquid in Comparative Example 1, whereby a comparative thermosensitive recording material No. 2 was prepared.

The thus prepared thermosensitive recording materials No. 4 through No. 6 according to the present invention and the comparative thermosensitive recording material No. 2 were subjected to the same tests as in Example 1. The results are shown in Table 2.

TABLE 2

| | $ZnCl_2$-Containing Layer | Image Density | Background Density | Moisture Resistance | Heat Resistance | Plasticizer Resistance |
|---|---|---|---|---|---|---|
| Example 1 | Undercoat Layer | 1.30 | 0.06 | 1.30 | 0.10 | Not faded |
| Example 2 | Protective Layer | 1.20 | 0.06 | 1.20 | 0.10 | Not faded |
| Example 3 | Thermosensitive Coloring Layer | 1.30 | 0.06 | 1.30 | 0.10 | Not faded |
| Comparative Example 2 | Thermosensitive Coloring Layer | 1.30 | 0.15 | 0.30 | 0.25 | Images disappeared |

As can be seen from the above results, the thermosensitive recording materials according to the present invention are excellent in the coloring performance, yielding high image density, in the whiteness of the background and in the preservability and stability of the images.

The thermosensitive recording materials according to the present invention can be employed as thermosensitive label sheets by forming an adhesive layer on the back side of the recording material and attaching a disposable backing sheet to the adhesive layer, which can be peeled off the adhesive layer when the thermosensitive recording materials are used.

As mentioned previously, the thermosensitive recording materials according to the present invention can also be used in the form of an image-transfer type recording material consisting of an image transfer sheet with an image-transfer layer thereon containing the above-mentioned leuco dye and an image receiving sheet with an image receiving layer thereon containing the above-mentioned color developer.

In the image-transfer type recording material, the thermosensitive coloring layer can contain either the color developer or the leuco dye, constituting the image receiving layer or the image transfer layer formed on the support material, with the image receiving layer and the support material integrally constituting an image receiving sheet or the image transfer layer and the support material integrally constituting an image transfer sheet.

The following is an example of such an image-transfer type recording material according to the present invention.

EXAMPLE 7

Preparation of Image Transfer Sheet

A mixture of the following components was dispersed in a ball mill for 24 hours, whereby an image transfer layer formation liquid was prepared.

| | |
|---|---|
| 3-di(n-butyl)amino-7-o-chloroanilinofluoran | 24 g |
| methyl 4-benzoyloxybenaoate | 24 g |
| 10% aqueous solution of ethylcellulose | 38 g |
| Water | 200 g |

The thus prepared image transfer layer formation liquid was applied by a wire bar to a sheet of typewriting paper with a base weight of 15 g/m$^2$ with a deposition of the above solid components thereof in an amount of 14 g/m$^2$ when dried, whereby an image transfer sheet was prepared.

Preparation of Image Receiving Sheet

A mixture of the following components was dispersed in a ball mill for 24 hours, whereby an image receiving layer formation liquid was prepared.

| | |
|---|---|
| 1,3-di(m-chlorophenyl)thiourea | 25 g |
| 10% aqueous solution of polyvinyl alcohol | 35 g |
| Silica particles | 12.5 g |
| Water | 200 g |

The thus prepared image receiving layer formation liquid was applied to a sheet of high quality paper (35 g/m$^2$)by a wire bar, with a deposition of the solid components thereof in an amount of 6 g/m$^2$ when dried, whereby an image receiving sheet was prepared.

The image transfer sheet was superimposed on the image receiving sheet in such a manner that the image transfer layer of the image transfer sheet was in close contact with the image receiving layer of the image receiving sheet, and thermal printing was performed by a thermal head on the back side of the image transfer sheet. As a result, clear back images were formed on the image receiving sheet. The moisture resistance, the heat resistance and the plasticizer resistance of the thus obtained images were as excellent as those of the images obtained in Example 1.

The thermosensitive recording material according to the present invention can also be used as thermosensitive-recording type magnetized tickets and as recording sheets for use with a thermosensitive-recording type facsimile apparatus.

What is claimed is:

1. A thermosensitive recording material comprising a support material and a thermosensitive recording layer formed thereon, in which thermosensitive coloring layer, colored images are formed by the reaction between a colorless or light-colored leuco dye of the following formula (I) and a color developer of the following formula (II) which is capable of inducing color formation in the leuco dye upon application of heat thereto,

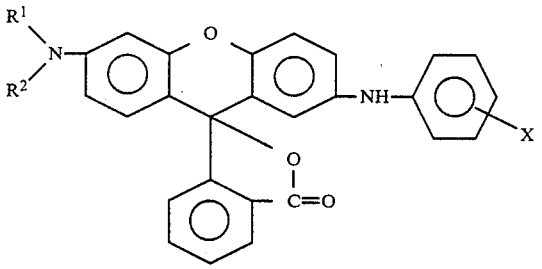

(I)

wherein $R^1$ and $R^2$ each indicate a lower alkyl group, and X indicates halogen,

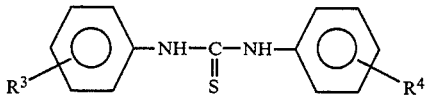

(II)

wherein $R^3$ and $R^4$ each indicate hydrogen, halogen, an alkyl group, an acyl group, a halogenated alkyl group or an unsubstituted or substituted aromatic group.

2. A thermosensitive recording material as claimed in claim 1, wherein said lower alkyl group represented by each of $R^1$ and $R^2$ in the formula (I) is an alkyl group having 1 to 5 carbon atoms.

3. A thermosensitive recording material as claimed in claim 1, wherein said aromatic group represented by each of $R^3$ and $R^4$ in said formula (II) is selected from the group consisting of an aryl group and an aralkyl group, and a substituent of said aromatic group is selected from the group consisting of halogen, an acyl group and a halogenated alkyl group.

4. A thermosensitive recording material as claimed in claim 1, wherein said thermosensitive coloring layer comprises as the main components said leuco dye and said color developer.

5. A thermosensitive recording material as claimed in claim 4, wherein the amount of said inorganic color developer is 5.0 parts by weight or less with respect to 1 part by weight of said color developer of the formula (II) in said thermosensitive coloring layer.

6. A thermosensitive recording material as claimed in claim 1, wherein said thermosensitive coloring layer comprises at least two layers, with said leuco dye contained in one layer and said color developer contained in the other layer.

7. A thermosensitive recording material as claimed in claim 1, wherein said thermosensitive coloring layer contans said color developer, constituting an image receiving layer formed on said support material, with said image receiving layer and said support material integrally constituting an image receiving sheet, and said leuco dye is contained in an image transfer layer formed on another support material, constituting an image transfer layer formed on said second mentioned support material, with said image transfer layer and said second mentioned support material integrally constituting an image transfer sheet.

8. A thermosensitive recording material as claimed in claim 1, wherein said thermosensitive coloring layer contains said leuco dye, constituting an image receiving layer formed on said support material, with said image receiving layer and said support material integrally constituting an image receiving sheet, and said color developer is contained in an image transfer layer formed on another support material, constituting an image transfer layer formed on said second mentioned support material, with said image transfer layer and said second mentioned support material integrally constituting an image transfer sheet.

9. A thermosensitive recording material as claimed in claim 1, wherein said thermosensitive coloring layer further comprises an inorganic color developer selected from the group consisting of zinc chloride, magnesium chloride, aluminium chloride, active terra abla, acidic terra abla, bentonite, colloidal silica, aluminium silicate, magnesium silicate and zinc silicate.

10. A thermosensitive recording material as claimed in claim 1, wherein said thermosensitive coloring layer further comprises a binder agent selected from the group consisting of polyvinyl alcohol, starch and derivatives thereof, methoxycellulose, hydroxyethylcellulose, carboxymethylcellulose, sodium polyacrylate, polyvinyl pyrrolidone, styrene/maleic anhydride copolymer, isobutylene/maleic anhydride copolymer, polyacrylamide and gelatin, SBR latex, styrene/acrylic acid ester copolymer, vinyl chloride/vinyl acetate copolymer and polybutyl methacrylate.

11. A thermosensitive recording material as claimed in claim 1, wherein said thermosensitive coloring layer further comprises an auxiliary additive selected from the group consisting of calcium carbonate, zinc oxide, silica, barium sulfate, aluminum stearate and urea-formaldehyde resin.

12. A thermosensitive recording material as claimed in claim 1, wherein said thermosensitive coloring layer further comprises a thermo-fusible material with a melting point ranging from about 70° C. to about 150° C.

* * * * *